US008698679B2

(12) United States Patent
Lin

(10) Patent No.: US 8,698,679 B2
(45) Date of Patent: Apr. 15, 2014

(54) MARK ANTENNA AND ELECTRONIC DEVICE

(75) Inventor: Wen-Han Lin, Taipei County (TW)

(73) Assignees: Inventec Appliances (Shanghai) Co. Ltd, Shanghai (CN); Inventec Appliances Corp., New Taipei (TW)

( * ) Notice: Subject to any disclaimer, the term of this patent is extended or adjusted under 35 U.S.C. 154(b) by 227 days.

(21) Appl. No.: 13/118,908

(22) Filed: May 31, 2011

(65) Prior Publication Data

US 2012/0032859 A1 Feb. 9, 2012

(30) Foreign Application Priority Data

Aug. 3, 2010 (CN) ..... 2010 2 0278435

(51) Int. Cl.
*H01Q 1/24* (2006.01)

(52) U.S. Cl.
USPC ..... 343/702; 343/700 MS

(58) Field of Classification Search
USPC ..... 343/700 MS, 702, 846, 848, 795
See application file for complete search history.

(56) References Cited

U.S. PATENT DOCUMENTS

| | | | | |
|---|---|---|---|---|
| 7,151,492 | B2 * | 12/2006 | Iguchi et al. | 343/700 MS |
| 7,746,278 | B2 * | 6/2010 | Zweers | 343/700 MS |
| 7,932,862 | B2 * | 4/2011 | Tsai et al. | 343/700 MS |
| 2006/0114121 | A1 * | 6/2006 | Cumeralto et al. | 340/870.02 |

* cited by examiner

*Primary Examiner* — Karl D Frech
(74) *Attorney, Agent, or Firm* — WPAT, P.C.; Anthony King; Kay Yang

(57) ABSTRACT

The present invention discloses a mark antenna used for receiving and transmitting a wireless signal. The mark antenna comprises a ground point, a feed point and a radiation part connecting to the ground point and the feed point, and particularly the radiation part is an identification mark, such that the appearance of the radiation part can provide identification information. With the light, thin, short and compact design concept, the mark antenna can be exposed to prevent the antenna from being compressed due to the small disposed area and overcome the difficulty of designing the antenna or a poor communication quality caused by the low performance of the antenna. In the present invention, the antenna is designed as a logo directly, such that the antenna can achieve the functions of identifying the appearance as well as transmitting and receiving the wireless signals.

4 Claims, 3 Drawing Sheets

MARK ANTENNA AND ELECTRONIC DEVICE

BACKGROUND OF THE INVENTION

1. Field of the Invention

The present invention relates to an antenna, and more particularly to a mark antenna.

2. Description of Related Art

Most of the existing electronic products come with a wireless transmission feature such as WLAN or Bluetooth. With the miniaturization trend of the electronic products, the mechanism space is limited during the product planning; wherein, the design and position of antennas have strong influences on the product performance. Currently, most antennas are built-in designs, and owing to the smaller mechanism space, the disposed area for antennas is strictly limited and therefore antennas performance is degraded.

Consumer electronics usually have identification marks on their casing body, and the identification marks can be words or figures to provide consumers identification information such as a trademark, a feature or a name of an electronic product, thereby achieving the goals of the brand and product identification or marketing. The word or figure marks are commonly provided for the appearance only; hence, there is still room for further improvements in the product function designs.

SUMMARY OF THE INVENTION

Therefore, the primary objective of the present invention is to provide a mark antenna for receiving and transmitting a wireless signal, and the mark antenna comprises a ground point, a feed point and a radiation part electrically connecting to the ground point and the feed point, wherein the radiation part comprises an identification mark, such that the appearance of the radiation part provides identification information.

In a preferred embodiment of the present invention, the identification mark includes at least one word, and the at least one word includes a first character, a second character, and successive characters, which are all electrically connected in order.

In a preferred embodiment of the present invention, the identification mark comprises a figure for providing the identification information.

In a preferred embodiment of the present invention, the identification information is provided for identifying a brand, a feature or a name of an electronic product.

In a preferred embodiment of the present invention, the ground point and the feed point can be flexible structures, and each of the ground point and feed point further include a convex point.

In a preferred embodiment of the present invention, the identification mark includes at least one word, and the at least one word includes a first character, a second character, and successive characters, which are all connected in order.

Another objective of the present invention is to provide an electronic device for receiving and transmitting a wireless signal, and the electronic device comprises a casing body, a base board disposed in the casing body, a computing unit disposed on the base board, a wireless transceiver module electrically connected to the computing unit and disposed on the base board, and an antenna. The antenna comprises a ground point, a feed point and a radiation part electrically connecting to the ground point and the feed point, and the radiation part comprises an identification mark, such that the appearance of the radiation part provides identification information. The feed point of the antenna electrically connects to the wireless transceiver module, and the antenna is disposed on the base board through the ground point and the feed point. The radiation part is exposed on the exterior surface of the casing body.

Based on the aforementioned, with the light, thin, short and compact design concept, the mark antenna of the present invention can be exposed to prevent the antenna from being compressed due to the small disposed area and overcome the difficulty of designing the antenna or a poor communication quality caused by the low performance of the antenna. In the present invention, the antenna is designed as a logo directly, such that the antenna can achieve the functions of identifying the appearance as well as transmitting and receiving the wireless signals.

DETAILED DESCRIPTION OF THE PREFERRED EMBODIMENTS

Figure 1:
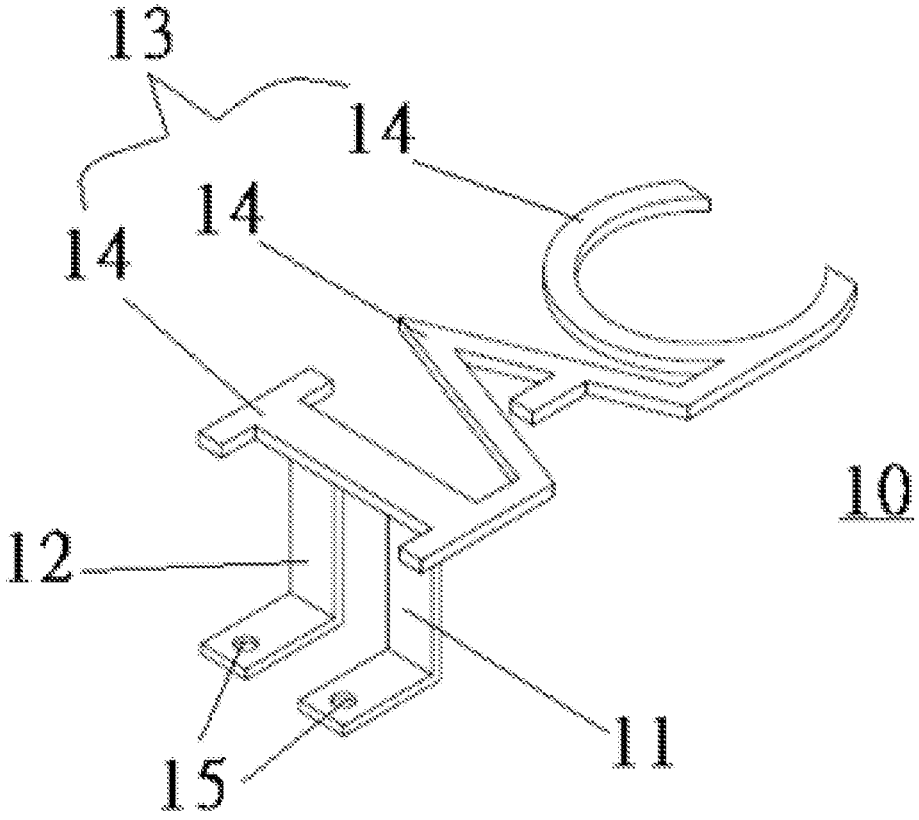
FIG. 1 is a schematic structural view of a mark antenna structure in accordance with a first preferred embodiment of the present invention.

Please refer to FIG. 1, which is a schematic structural view of a mark antenna structure in accordance with a first preferred embodiment of the present invention. As shown in FIG. 1, the mark antenna 10 comprises a ground point 12, a feed point 11 and a radiation part 13. In this preferred embodiment, the mark antenna 10 is manufactured by an insert molding process, and in form of a PIFA (generally known as a coplanar inverted-F antenna). The mark antenna 10 uses a frequency of approximately 2.4 Ghz and a bandwidth of approximately 2.4 Ghz to 2.5 Ghz, and is compliant with the 802.11 B/G specification. The mark antenna 10 can be used for receiving and transmitting wireless signals, particularly for WLAN (Wi-Fi) and Bluetooth.

The radiation part 13 comprises an identification mark 14, and the identification mark 14 of this preferred embodiment includes but not limited to three characters, respectively: I, A and C, which can be substitute by other figures, words or symbols corresponding to the functions of the antenna. The characters I, A and C are electrically and sequentially connected to one another, such that the appearance of the radiation part 13 composed of IAC can provide identification information and allow users to identify a representative brand, a feature or a name of an electronic product. The identification mark 14 formed from the three characters: I, A and C of the radiation part 13 electrically connects to the ground point 12 and the feed point 11, and a conductor formed from the three characters IAC (which is generally made of copper and electroplated) can radiate signals out. The total length of the conductor is generally selected to be $\lambda/4$ according to a formula, wherein $\lambda$ is the wavelength of the electromagnetic wave, and $\lambda=C/F$, whose C (speed of the light) is equal to 3×108 m/sec, and F, the center frequency of the antenna, is equal to 2.45 Ghz. Generally speaking, since the periphery of the conductor is made of a plastic material, whose dielectric constant affects $\lambda$, the actual total length of the conductor is about $\frac{2}{3}\lambda$.

Figure 2:
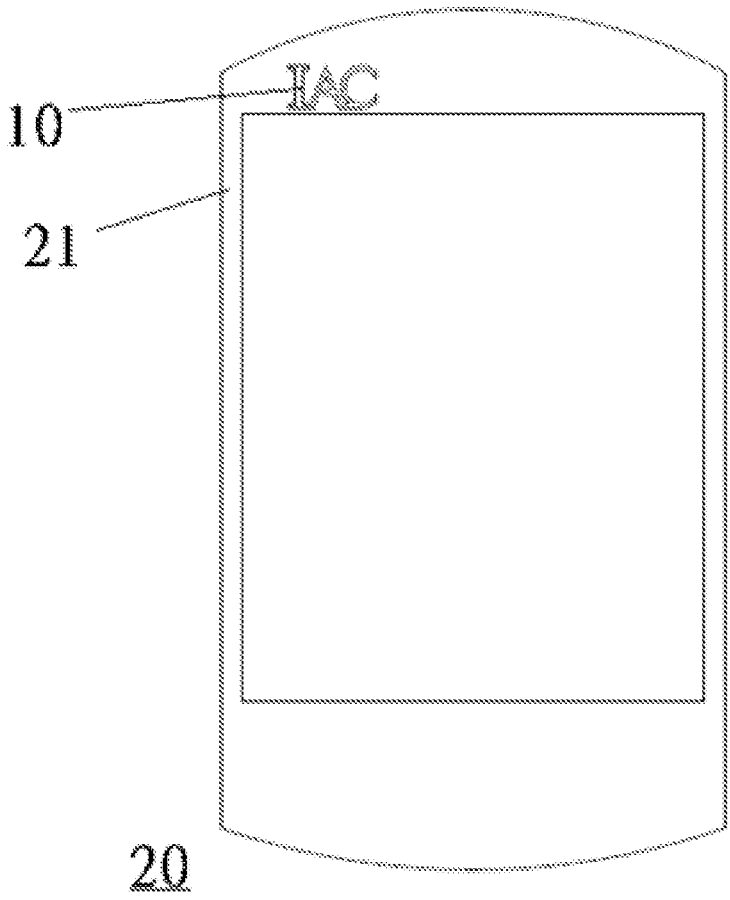
FIG. 2 is a schematic view of a device appearance in accordance with a second preferred embodiment of the present invention.
Figure 3:
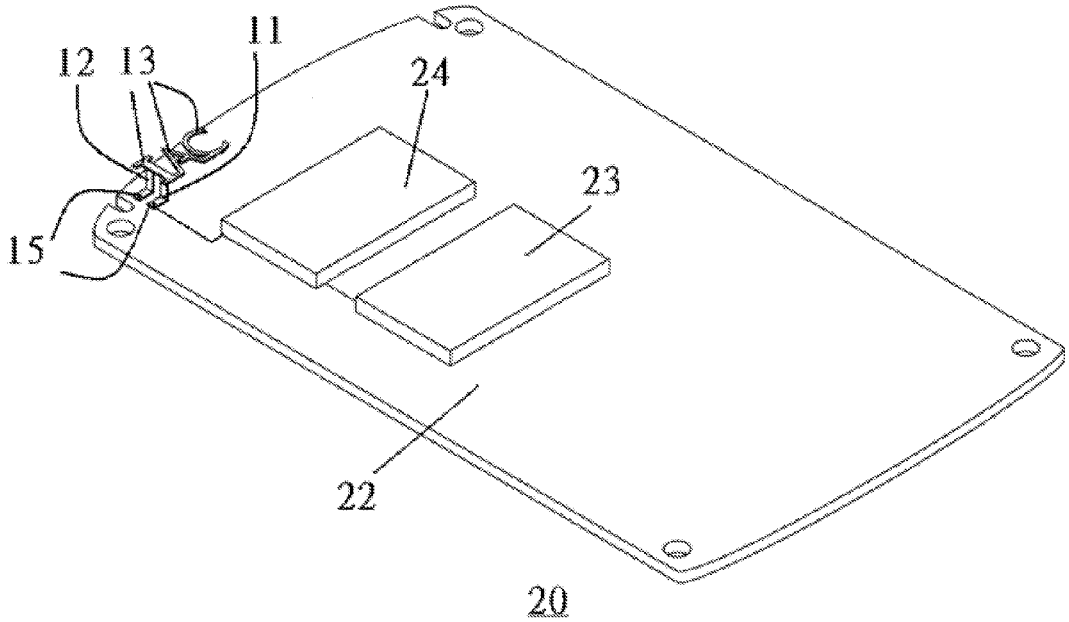
FIG. 3 is a schematic structural view of a device structure in accordance with a second preferred embodiment of the present invention.

Please refer to FIG. 2 and FIG. 3. FIG. 2 is a schematic view of a device appearance in accordance with a second preferred embodiment of the present invention. FIG. 3 is a schematic structural view of a device structure in accordance with a second preferred embodiment of the present invention. Hereby declare that the components of the second preferred embodiment are as the same as those of the first preferred embodiment, thus presented with the same numerals. As shown in FIGS. 2 and 3, the electronic device 20 comprises a casing body 21, a base board 22 disposed in the casing body 21, a computing unit 23 disposed on the base board 22, a wireless transceiver module 24 electrically connects to the computing unit 23 and disposed on the base board 22, and an antenna 10. The electronic device 20 can receive or transmit wireless signals through the antenna 10, such as WLAN and Bluetooth. The antenna 10 is manufactured by an insert molding process, and in a form of PIFA (commonly known as a coplanar inverted-F antenna). The antenna 10 uses a frequency of approximately 2.4 Ghz and a bandwidth of approximately 2.4 Ghz to 2.5 Ghz, and is compliant with the 802.11 B/G specification. The antenna 10 comprises a ground point 12, a feed point 11 and a radiation part 13 electrically connecting to the ground point 12 and the feed point 11. The radiation part 13 is an identification mark 14, such that the appearance of the radiation part 13 can provide identification information (such as the IAC in this preferred embodiment). The feed point 11 of the antenna 10 electrically connects to the wireless transceiver module 24, and the antenna 10 is disposed on the base board 22 through the ground point 12 and the feed point 11. The radiation part 13 is exposed on the exterior surface of the casing body 21, so that users can identify a brand, a feature or a name of the electronic device 20. Each of the ground point 12 and the feed point 11 can be a flexible structure, and each of the ground point 12 and the feed point 11 further include a convex point 15, such that the copper foils on the antenna 10 and on the base board 22 can maintain a good contact and a stable contact in vibration and drop tests.

The foregoing detailed description should be regarded as illustrative rather than limiting and the appended claims including all equivalents are intended to define the scope of the invention.

What is claimed is:

1. An electronic device for receiving and transmitting a wireless signal, comprising:

a casing body;

a base board disposed inside the casing body;

a computing unit disposed on the base board;

a wireless transceiver module disposed on the base board, wherein the wireless transceiver module is electrically connected to the computing unit; and an antenna comprising:

a ground point;

a feed point; and a radiation part exposed on the exterior surface of the casing body, and connecting to the ground point and the feed point, comprising an identification mark to provide identification information thereon;

wherein the feed point of the antenna is electrically connected to the wireless transceiver module;

the antenna is disposed on the base board by the ground point and the feed point;

wherein the ground point and the feed point are flexible structures, and the ground point and the feed point each comprises a convex point to allow the antenna to be disposed on the base board.

2. The electronic device as described in claim 1, wherein the identification mark comprises at least one word; the word further includes characters electrically connected in order.

3. The electronic device as described in claim 1, wherein the identification mark comprises a figure providing the identification information.

4. The electronic device as described in claim 1, wherein the identification information is provided for identifying a brand, or a feature or a name of an electronic product.

* * * * *